US005845812A

United States Patent [19]

Morrison

[11] Patent Number: 5,845,812

[45] Date of Patent: Dec. 8, 1998

[54] PAINT POUCH FITTING

[75] Inventor: Adam P. Morrison, Rockford, Ill.

[73] Assignee: The Testor Corporation, Ohio

[21] Appl. No.: 595,101

[22] Filed: Jan. 31, 1996

[51] Int. Cl.[6] ..... B65D 17/30

[52] U.S. Cl. ..... 222/83; 222/107

[58] Field of Search ..... 222/81, 83, 83.5, 222/107

[56] References Cited

U.S. PATENT DOCUMENTS

| | | | |
|---|---|---|---|
| 103,640 | 5/1870 | Merritt . | |
| 859,711 | 7/1907 | Winsor . | |
| 943,234 | 12/1909 | Brooks . | |
| 1,475,116 | 11/1923 | Harvey . | |
| 2,830,396 | 4/1958 | Gowland . | |
| 2,869,162 | 1/1959 | Dritz . | |
| 2,893,710 | 7/1959 | Goodman . | |
| 3,000,152 | 9/1961 | Downie . | |
| 3,070,824 | 1/1963 | Martin . | |
| 3,070,825 | 1/1963 | Martin . | |
| 3,205,889 | 9/1965 | Alder et al. . | |
| 3,918,820 | 11/1975 | Kim . | |
| 3,960,294 | 6/1976 | Bernard . | |
| 4,010,786 | 3/1977 | Aguettant et al. . | |
| 4,257,535 | 3/1981 | Mellett . | |
| 4,440,316 | 4/1984 | Christine | 222/83.5 |
| 4,484,904 | 11/1984 | Fowler . | |
| 4,516,691 | 5/1985 | Christine et al. | 222/83.5 |
| 4,567,999 | 2/1986 | Hjertman et al. . | |
| 4,570,826 | 2/1986 | Fattori | 222/83 |
| 4,601,410 | 7/1986 | Bond . | |
| 4,624,392 | 11/1986 | Malpas et al. | 222/83 |
| 4,650,452 | 3/1987 | Jensen . | |
| 4,696,411 | 9/1987 | Graf et al. | 222/81 X |
| 4,722,457 | 2/1988 | Bedwell . | |
| 4,732,299 | 3/1988 | Hoyt . | |
| 4,779,997 | 10/1988 | Schmidt . | |
| 4,948,014 | 8/1990 | Rutter et al. | 222/83 |
| 5,000,602 | 3/1991 | Kim . | |
| 5,105,984 | 4/1992 | Kazimir . | |
| 5,290,105 | 3/1994 | Tencati . | |
| 5,348,525 | 9/1994 | Buchanan . | |
| 5,622,283 | 4/1997 | Morrison | 222/107 |

FOREIGN PATENT DOCUMENTS

| | | | |
|---|---|---|---|
| 0322980 | 7/1989 | European Pat. Off. | 222/83 |
| 677-093 | 4/1991 | Switzerland . | |
| 2082152 | 3/1982 | United Kingdom | 222/83 |
| WO 86/04545 | 8/1986 | WIPO . | |

*Primary Examiner*—Kenneth Bomberg
*Attorney, Agent, or Firm*—Fay, Sharpe, Beall, Fagan, Minnich & McKee

[57] ABSTRACT

A paint pouch fitting for a paint dispensing system comprising a piston slidable within a housing. A passage in the housing includes an inlet communicating with a paint pouch, and an outlet. The passage also includes a piercable membrane positioned between the inlet and the outlet. The piston includes a blade for piercing the membrane. The positioning of the piston within the passage defines two working positions allowing for four operational modes of shipping, piercing, dispensing, and storing.

23 Claims, 5 Drawing Sheets

PAINT POUCH FITTING

BACKGROUND OF THE INVENTION

The subject invention is directed to the art of dispensing systems, and more particularly to a fitting for controlling access to a paint dispensing apparatus such as a collapsible pouch or bag assembly. The invention is particularly applicable to a paint pouch having a fitting disposed at one end that is received in the dispensing apparatus. Through application of pressure, the dispensing apparatus squeezes paint from the pouch cavity through the outlet in the fitting. The fitting provides a membrane which, prior to puncture, seals the paint within the pouch. The fitting also provides a valve for selectively allowing and prohibiting paint flow through the fitting, depending upon its position.

Generally speaking, collapsible bags or pouches used for storing paint for use with a brush or other dispensing tip are known in the art. For example, U.S. Pat. Nos. 103,640; 1,475,116; 2,869,162; 2,893,710; 3,070,824; 3,070,825; 3,918,820; 3,960,294; and, 5,000,602 generally describe and illustrate known arrangements. Some of these dispensing apparatus are intended for use in painting large surface areas, as opposed to providing small amounts of paint required by an artist or graphic designer. Moreover, these prior structures are relatively complex and limited to a particular end use.

Use of a collapsible pouch for storing the paint typically includes a valve structure to regulate fluid flow therefrom. Depending upon the complexity of the valve, it often comprises a major portion of the overall cost of the system so that expensive valves are not desirable. In contrast, a low-cost, reliable valving arrangement that can be easily manipulated by a consumer between a closed and open position which also prevents leakage from the pouch when not in use is preferred.

It is also desirable to provide a system that is sealed until its first use, i.e., during shipment and prior to first use. It is further desirable to provide a way and device for breaking or opening this seal where the device is of low-cost and reliable, as well as easy to manipulate by a user.

It is ultimately desirable to provide a system wherein the valve supplies both a way to break or open a sealed paint pouch at the time of first use, and to regulate fluid flow therefrom during an in-between future use. Such a valve structure must be low/cost, reliable, and easily manipulated by a consumer.

SUMMARY OF THE INVENTION

The present invention contemplates a new and improved paint pouch fitting for a paint dispensing system that overcomes the above-referenced problems and others, and provides a simple, easy to use valve for initially breaking a seal and thereafter controlling fluid flow out of the paint pouch.

According to a more limited aspect of the invention, the paint pouch fitting includes a housing that has a chamber therein. A piston slides in the chamber for breaking the seal and controlling paint flow out of the paint pouch. Specifically, the chamber includes a piercable membrane covering a fluid passageway between the paint pouch and an end port. The piston has a blade for piercing the membrane and thereby providing a fluid access path. The piston also functions to open and close the fluid passageway when paint dispensing is desired or not desired, respectively.

A principal advantage of the invention resides in the simplified construction of the paint pouch fitting for dispensing paint or other fluid from a collapsible pouch.

Another advantage of the invention resides in the ease with which paint flow from the pouch can be regulated and dispensed in a controlled manner.

Yet another advantage of the invention is the simplicity of use whereby a valve is slidable from a first position to a second position within a housing resulting in four different applications or uses of the paint pouch.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in the specification and illustrated in the accompanying drawings which show.

DETAILED DESCRIPTION OF THE PREFERRED EMBODIMENT

Figure 2:
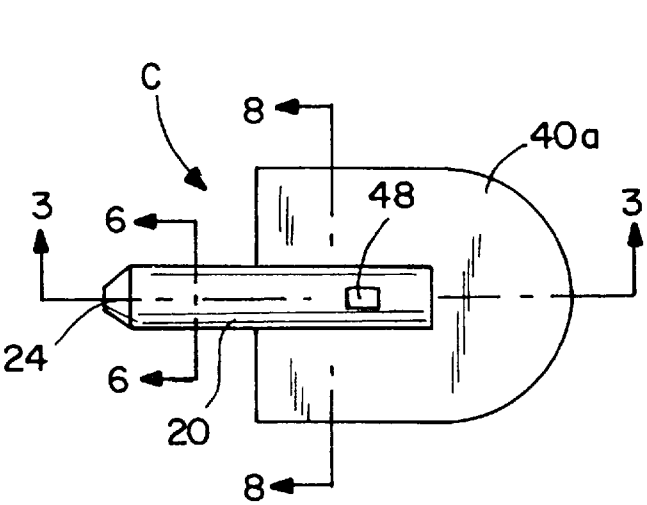
FIG. 2 is a top plan view of the housing assembly of the paint pouch fitting.
Figure 1:
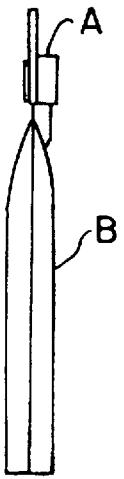
FIG. 1 is an elevational view of a paint pouch employing the subject invention.

Referring now to the drawings wherein the showings are for the purpose of illustrating the preferred embodiments of the invention only and not for purposes of limiting the same. Although the invention will be described with particular reference to the preferred embodiments, it will be appreciated that the invention has broader applications and may be advantageously employed in related environments and applications. Generally, the FIGURES show a fitting A used with a dispensing apparatus in a wide variety of applications. More particularly, fitting A is secured to a pouch or container B of generally rectangular configuration defined by a single sheet of material that is folded at one end. The free ends of the sheet are brought together to define a pair of planar sidewalls. The sheet is preferably polyethylene construction and sealed along its peripheral portions, preferably by heat sealing. When the edges are heated, the material of one sidewall fuses to the other sidewall along the periphery in a manner generally well known in the art. The central portions of the sidewalls spaced inwardly from the periphery remain unfused and can thereby expand and contract toward and away from one another to store a fluid, such as paint, therein. Eventually, the paint is dispensed from the pouch as will be further described below. Further details of the construction and operation of the pouch can be found in commonly owned and copending application Ser. No. 08/381,549, filed Jan. 31, 1995 , now U.S. Pat. No. 5,622,283.

Mounted between facing peripheral, fused portions of the pouch is a fitting A, preferably formed of a polyethylene material. The fitting allows paint stored in the pouch to be selectively dispensed therefrom. The fitting includes a housing C and a piston D disposed to selectively move relative to the housing C to open and close a passage formed therein.

The fitting housing C is shown in more detail in FIGS. 2–9. It has a hollow cylindrical portion 20 which defines an internal passage 22 (FIG. 3) having openings 24, 26 at opposite ends. The first end opening 24 is of reduced dimension while the second end opening 26 is slightly larger than the remainder of the passage to receive the piston as will be described in greater detail below. Moreover, the passage includes a pair of internal grooves 32, 34 that cooperate with the piston to secure the piston in first and second positions relative to the fitting housing. Again, further details will be described below of the function of the grooves.

A generally planar flange 40 extends tangentially from the cylindrical portion and is heat sealed between the peripheral edges of the pouch sidewalls as described above. The enlarged flange 40 provides the necessary surface area needed to heat seal the fitting housing to the pouch B and to supply the desired rigidity and support required for dispensing paint via the fitting.

A third opening or port 42 extends through the flange (FIG. 4) and is initially closed from communication with the passage because of the presence of a membrane 44. The membrane 44 is adapted to be selectively pierced to establish a flow path between the interior of the pouch (through port 42) and the passage 22, particularly through the first end opening 24. Until the membrane is pierced, however, the pouch interior is sealed and paint cannot be dispensed through the fitting.

Housing C further includes a projection or nub 48 on its outer surface which cooperates with the piston to act as a locking mechanism in a manner to be described below. The second component of the fitting assembly is the valve or piston D, individually illustrated in FIGS. 10–15. It has a generally cylindrical base 50 from which an elongated pin 52 extends. The outermost end of the pin includes a reduced diameter nose 54 that is dimensioned for sealing receipt in the first end opening 24 of the housing. The remainder of the pin is dimensioned for sliding receipt in the passage 22 of the housing. The pin is slightly smaller in diameter than the passage so the paint, or other fluid stored in the pouch can flow through the passage around the pin toward the outlet once the membrane has been pierced.

To pierce the membrane, a blade 60 extends from the body. Preferably, the blade extends in generally parallel relation with the pin in a longitudinal direction from the base 30. The blade has a cutting edge 62 defined at its distal end. In the preferred embodiment, this cutting edge includes a pair of faces 64 (FIG. 15) angled relative to one another and also angled or tapered relative to the longitudinal axis of the blade. Thus, a sharpened point is formed that is used to initiate piercing of the membrane.

Extending from the opposite end of base 50, and initially in a substantially transverse manner, is tab 70. The tab 70 has a major portion that extends parallel to the pin and blade, although it is preferably diametrically disposed from the blade. The major portion of the tab is planar in nature (FIG. 10) and includes a nub engaging lock 72 facing inwardly toward the base and a plurality of spaced ridges 74 on an outwardly extending face. The ridges facilitate gripping of the piston by a user and the lock cooperates with the nub 48 to retain the piston on the fitting housing. That is the nub and lock axially slide over another in an axial direction as the piston is inserted into the housing and the pin is guided into the passage. The tab is resiliently flexed outwardly away from the body until the lock and nub snap fit over one another. The configurations of the lock and nub then prevent removal of the piston from the housing.

Figure 16:
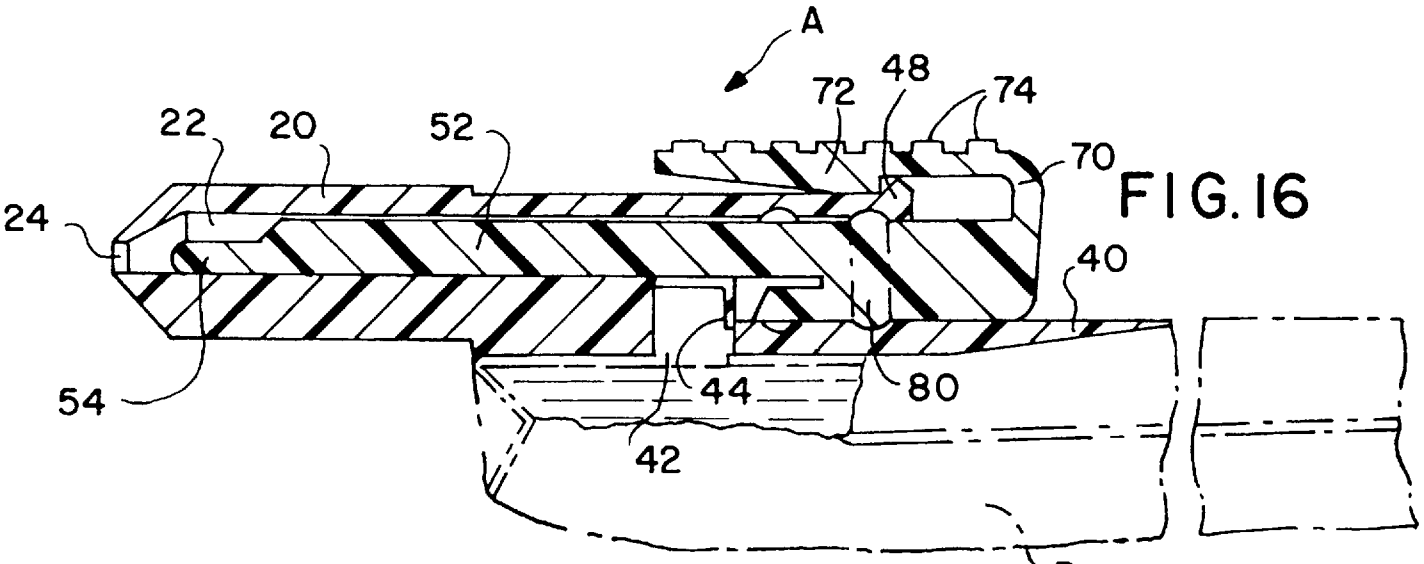
FIG. 16 is a sectional view of the valve assembly of FIGS. 10–15 inserted into the housing assembly of FIGS. 2–9 showing the valve assembly in a first position.

The base 50 further includes a protrusion 80. In the preferred embodiment, this protrusion is a circumferentially continuous raised land that cooperates with the first and second grooves 32, 34 disposed in the passage. Four distinct operational modes are defined by two housing-piston positions. The first position is shown in FIG. 16, while the second position is illustrated in FIG. 17.

Figure 3:
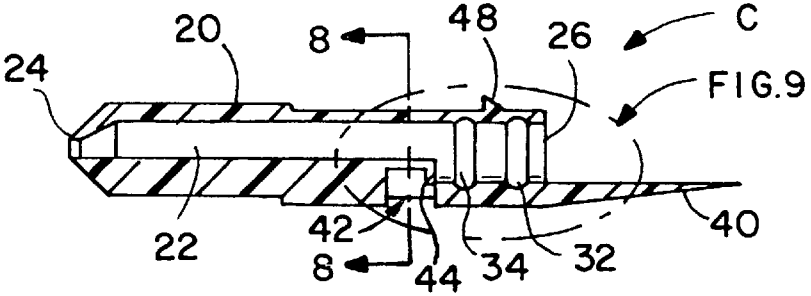
FIG. 3 is a longitudinal cross-sectional view of the housing assembly taken generally along the lines 3—3 in FIG. 2.
Figure 5:
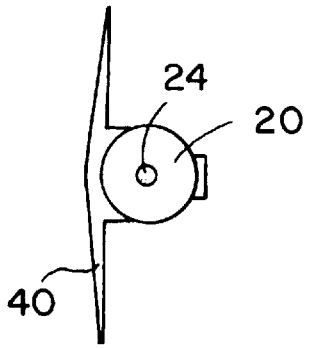
FIG. 5 is an end view of the housing assembly taken generally from the left-hand end of FIG. 2.
Figure 6:
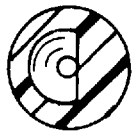
FIG. 6 is a cross-sectional view taken generally along the lines 6—6 of FIG. 2.
Figure 7:
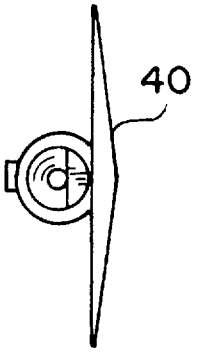
FIG. 7 is an end view of the housing assembly taken generally from the right-hand end of FIG. 2.
Figure 8:
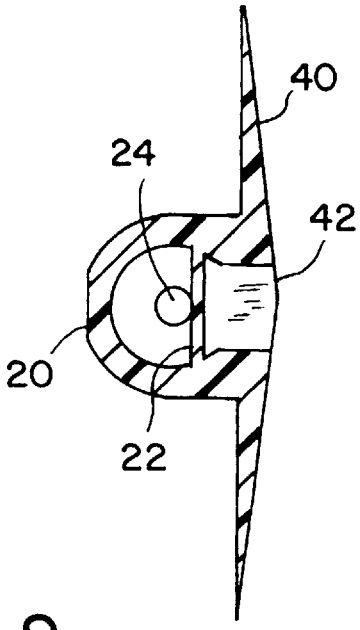
FIG. 8 is a cross-sectional view taken generally along the lines 8—8 of FIG. 2.
Figure 9:
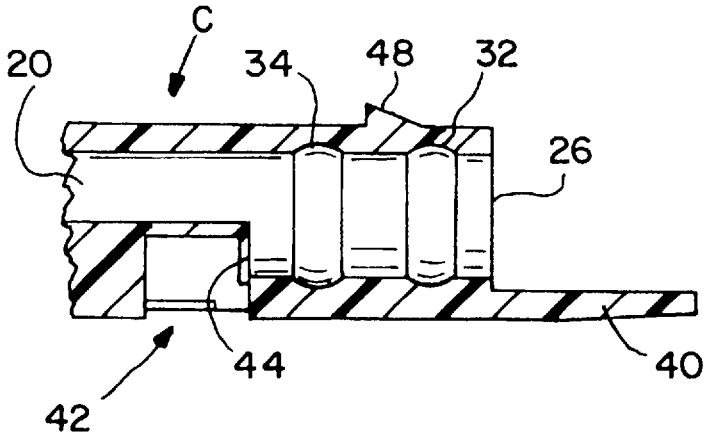
FIG. 9 is an enlarged cross-sectional view of the encircled area in FIG. 3.
Figure 10:
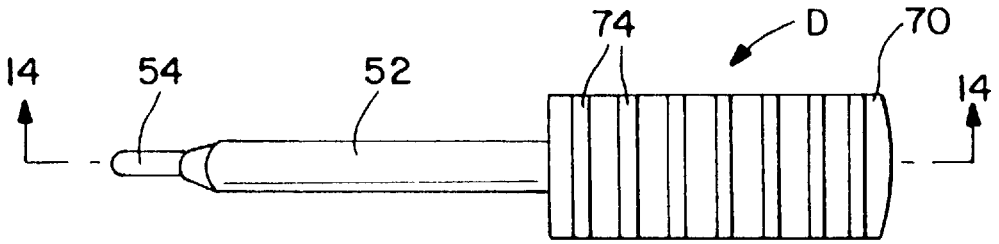
FIG. 10 is a top plan view of a piston assembly used within the paint pouch fitting.
Figure 11:
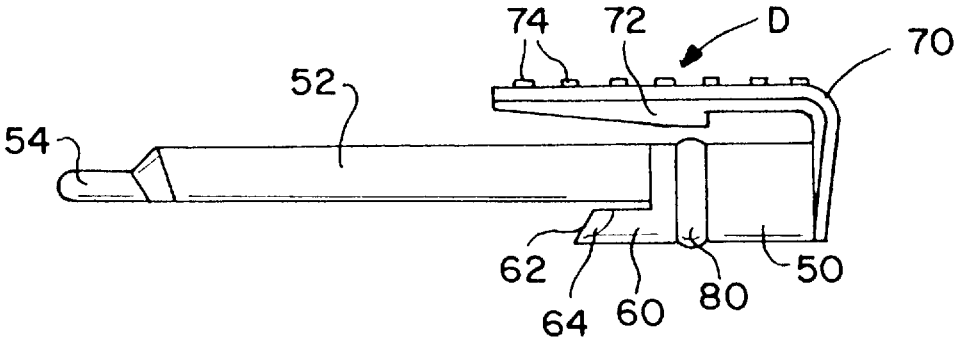
FIG. 11 is a side elevational view of the piston assembly of FIG. 10.
Figure 12:
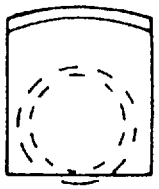
FIG. 12 is an end elevational view of the piston assembly generally taken from the right-hand end of FIGS. 10 and 11.
Figure 13:
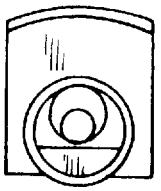
FIG. 13 is an end elevational view of the piston assembly generally taken from the left-hand end of FIGS. 10 and 11.
Figure 14:
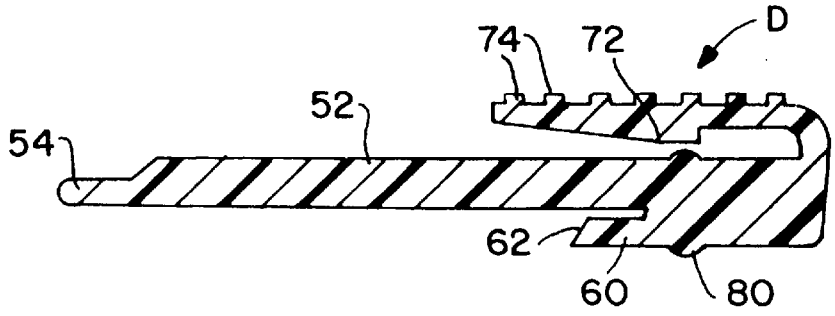
FIG. 14 is a longitudinal cross-sectional view taken generally along the lines 14—14 of FIG. 10.

Specifically, the first operational mode is used during shipment since the contents of the pouch remain sealed since the membrane is still intact. In this first mode, the pouch B is filled with paint at the manufacturing facility and the pouch B is sealed since the fitting membrane 44 is yet to be pierced (FIGS. 3, 9, and 16). Piston D is inserted into the housing C such that nub has interlocked within nub-engaging lock to prevent removal of piston D absent some undue outward bending force on the tab. The protrusion on the body is received in the first groove 32 to retain the piston and housing in the first position during shipment.

Figure 18:
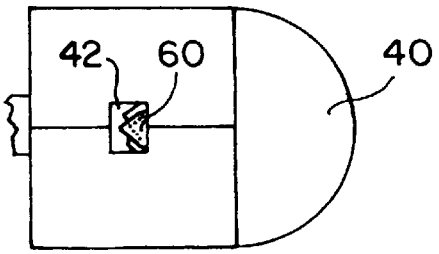
FIG. 18 is a bottom plan view of the housing assembly after the valve assembly has pierced the sealing membrane.
Figure 17:
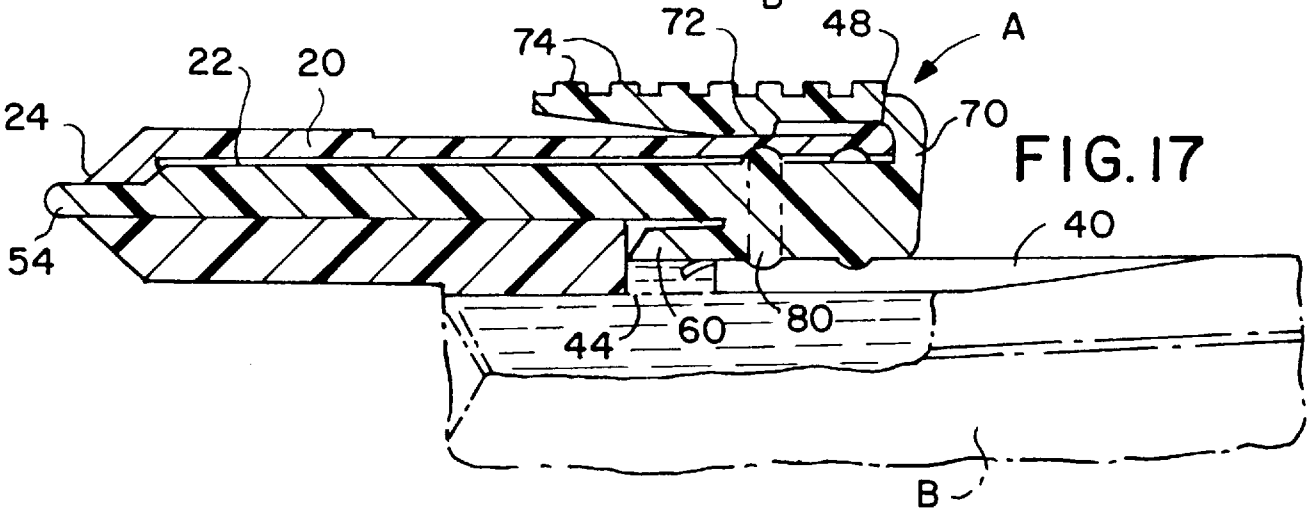
FIG. 17 is a sectional view of the valve assembly and housing assembly of FIG. 16 in a second position.

When dispensing of the paint is desired, typically by the end user, the piston D is pushed further into the passage 22 such that blade 60 pierces the membrane, as is shown in FIGS. 17–18. In this second operational mode, the piston is advanced axially until the land is unseated from the first groove and seats in the second groove 34. This provides a positive tactile sensation to the end user that the piston has been advanced to the second position and that the membrane has been pierced.

Figure 15:
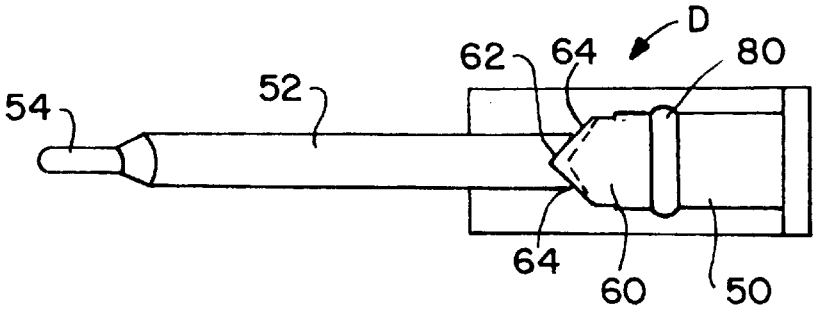
FIG. 15 is a bottom plan view of the piston assembly of FIGS. 10 and 11.
Figure 19:
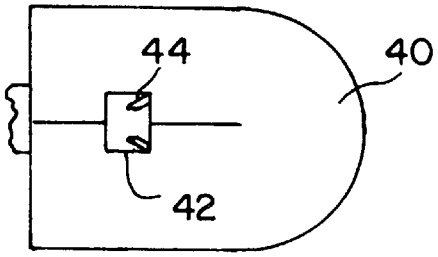
FIG. 19 is a bottom plan view similar to FIG. 18 after the blade has been removed from the pierced membrane.

To dispense paint, piston D after piercing the membrane, must be slightly retracted in the passage 22 to the first position as is shown in FIG. 15. This first position is, again, defined by locating the land in the first groove 32. As best shown in FIG. 16, the pin is spaced from the sidewall defining the passage through the housing. Therefore, when the nose 54 is retracted from the first end opening 24 and the membrane has been pierced (FIG. 19), paint can flow from the pouch interior, through port 42, into the passage 22 about the pin and communicate with the first end opening.

When it is desired to shut off the flow of paint, it is necessary to close the fluid path described above. This prevents drying up of the paint or leakage of paint from the pouch. The piston-housing structure of the subject invention achieves this shutoff by advancing the piston D in passage 22 to the second position. That is, by locating the pin, and particularly the nose, in the opening (FIGS. 17–18), paint flow is shut off. The nose sealingly engages the opening thereby sealing off the paint flow passage. Moreover, the blade closes the formed opening in the membrane to cut off the flow of the paint at that location. Again, the land is disposed in the second groove 34 to provide a positive indication that the piston is properly positioned to seal the opening and prohibit further paint flow. The end user can then subsequently move the piston relative to the fitting housing between the first and second positions to regulate paint flow as desired.

In summary, although four operational modes are involved during the shipping, membrane piercing paint dispensing, and storage of the paint pouch, paint pouch fitting A requires only two positions to fulfill these four operational modes. Additionally, by sealing almost on the outside of the pouch, there is no place where the paint can dry and thus potentially plug the assembly. Further, since the opening formed in the membrane is of reduced diameter, pressure exerted on the pouch is less likely to create a force that overcomes the retention force defined between the land on the piston and the second groove in the housing passage.

Figure 4:
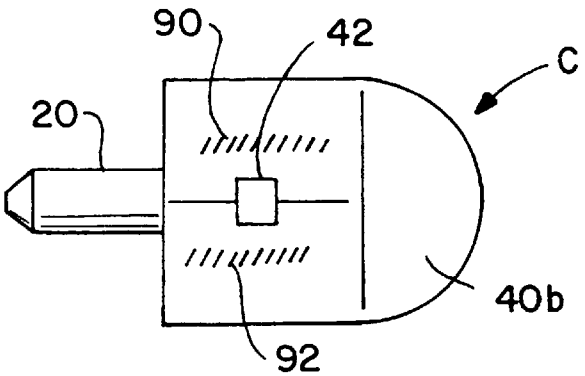
FIG. 4 is a bottom plan view of the housing assembly of FIG. 2.

It is also important that the fitting housing be preferably located on the centerline of the pouch. As best shown in FIG. 4, the enlarged flange is preferably secured to the pouch along shaded regions 90, 92 disposed on opposite sides of the port 42. Since the pouch has a tendency to pillow when filled with paint, the fitting can become angled, which is not desired. To maintain the fitting on the centerline of the pouch, the housing is sealed on both the first, or upper, and second, or lower, surfaces, i.e., 40*a*, 40*b* (FIGS. 2 and 4). The lower surface, however, is only sealed along the shaded regions so that paint can still flow through the port 42. This arrangement brings the fitting housing into alignment with the pouch centerline. The flange may also include grooves formed in the lower surface to facilitate paint flow to the port.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A paint pouch fitting comprising:

a housing having a chamber with an inlet port and an outlet port and a piercable membrane extending at least partially into the chamber and originally preventing fluid communication between the ports;

a piston slidable within the chamber between an open, first position and a closed, second position, the membrane being located in the chamber such that it is pierced upon an initial movement of the piston to the second position.

2. The paint pouch fitting as defined in claim 1 wherein the piston includes a blade for piercing the membrane.

3. The paint pouch fitting as defined in claim 2 wherein the piston includes a base from which the blade and an elongated pin with the tip thereon both axially extend.

4. The paint pouch fitting as defined in claim 3 wherein the piston includes a nub engaging lock attached to the base.

5. The paint pouch fitting as defined in claim 4 wherein the housing further includes a nub for receiving the nub engaging lock attached to the base.

6. The paint pouch fitting as defined in claim 1 wherein the piston includes a tip for closing the outlet port.

7. The paint pouch fitting as defined in claim 1 wherein the outlet port is defined in an end of the housing.

8. The paint pouch fitting as defined in claim 1 wherein the inlet port is a side port fluidly connected to the chamber when the piston is disposed in the first position.

9. The paint pouch fitting as defined in claim 8 wherein the chamber includes a compartment between the side port and the piercable membrane that is sealed from the chamber when the membrane is not pierced or when the piston is disposed in the second position.

10. The paint pouch fitting as defined in claim 1 wherein the chamber further comprises an attachment flange for attaching a paint pouch to the paint pouch fitting.

11. A paint pouch fitting comprising:

a chamber having a piercable membrane and an end port therein; and, means for both piercing the membrane and closing the end port during a same motion.

12. The paint pouch fitting as defined in claim 11 wherein the piercing and closing means is a valve positioned within the chamber.

13. The paint pouch fitting as defined in claim 12 wherein the valve comprises a blade for piercing the membrane.

14. The paint pouch fitting as defined in claim 12 wherein the valve comprises a tip for closing the end port.

15. The paint pouch fitting as defined in claim 11 further comprising a detent transversely extending into the chamber wherein the detent includes a compartment having a side port and the piercable membrane therein.

16. A paint pouch fitting comprising:

a valve body having a first port and a second port defining a fluid passageway therebetween;

a piercable membrane covering the fluid passageway; and a blade slidable within the fluid passageway for piercing the membrane.

17. The paint pouch fitting as defined in claim 16 further comprising a tip slidable within the fluid passageway for closing and opening the second port.

18. A fitting adapted for controlling fluid flow comprising:

a housing having an elongated chamber and an inlet and an outlet selectively communicating with the chamber;

a membrane provided in the chamber and interposed between the inlet and outlet for producing fluid flow until the membrane is pierced;

a piston received in the housing chamber movable between an open, first position and a closed, second position for controlling flow between the inlet and outlet; and a membrane piercing member operatively mounted for movement with the piston for piercing the membrane upon initial movement of the piston from the first position to the second position.

19. The fitting of claim 18 further comprising a location assembly for defining the first and second positions of the piston.

20. The fitting of claim 19 wherein the location assembly includes first and second grooves on the housing that cooperate with a protrusion on the piston.

21. The fitting of claim 18 further comprising a lock assembly on the housing and piston for preventing inadvertent removal of the piston once it is assembled with the housing.

22. The fitting of claim 21 wherein the lock assembly includes a wedge-shaped surface on the housing and a tapered surface on the piston that allow the piston to be inserted into the housing chamber during assembly.

23. The fitting of claim 18 wherein the membrane piercing member is parallel to the piston and cooperates with the pierced membrane to further regulate fluid communication between the inlet and the outlet.

* * * * *